US007517433B2

(12) United States Patent
Zwick et al.

(10) Patent No.: US 7,517,433 B2
(45) Date of Patent: Apr. 14, 2009

(54) SOFT PAPER SHEET WITH IMPROVED MUCUS REMOVAL

(75) Inventors: Kenneth John Zwick, Neenah, WI (US); Thomas Gerard Shannon, Neenah, WI (US); Michael John Rekoske, Appleton, WI (US); Kathy Geralyn Richardson, Combined Locks, WI (US); Paul Kerner Pauling, Appleton, WI (US); Mark Alan Burazin, Oshkosh, WI (US); Gary Lee Shanklin, Neenah, WI (US); Thomas Kremer, Appleton, WI (US); Benjamin Peter Sierra, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 523 days.

(21) Appl. No.: 10/566,860

(22) PCT Filed: Aug. 28, 2003

(86) PCT No.: PCT/US03/27310

§ 371 (c)(1), (2), (4) Date: Feb. 1, 2006

(87) PCT Pub. No.: WO2005/031068

PCT Pub. Date: Apr. 7, 2005

(65) Prior Publication Data

US 2006/0243405 A1 Nov. 2, 2006

(51) Int. Cl.
*D21H 21/22* (2006.01)

(52) U.S. Cl. ..... 162/109; 162/135; 162/158; 162/111; 428/195.1

(58) Field of Classification Search ..... 162/109, 162/111–113, 123–133, 135, 158; 428/152–153, 428/156, 172, 195.1
See application file for complete search history.

(56) References Cited

U.S. PATENT DOCUMENTS

| | | | | |
|---|---|---|---|---|
| 3,556,932 | A | 1/1971 | Coscia | |
| 3,556,933 | A | 1/1971 | Williams | |
| 3,700,623 | A | 10/1972 | Keim | |
| 3,772,076 | A | 11/1973 | Keim | |
| 3,855,158 | A | 12/1974 | Petrovich et al. | |
| 3,899,388 | A | 8/1975 | Petrovich et al. | |
| 4,129,528 | A | 12/1978 | Petrovich et al. | |
| 4,147,586 | A | 4/1979 | Petrovich et al. | |
| 4,222,921 | A | 9/1980 | Van Eenam | |
| 4,950,545 | A | 8/1990 | Walter et al. | |
| 5,059,282 | A * | 10/1991 | Ampulski et al. | 162/111 |
| 5,227,242 | A | 7/1993 | Walter et al. | |
| 5,538,595 | A | 7/1996 | Trokhan et al. | |
| 5,558,873 | A | 9/1996 | Funk et al. | |
| 5,573,637 | A | 11/1996 | Ampulski et al. | |
| 5,607,551 | A | 3/1997 | Farrington et al. | |
| 5,656,132 | A | 8/1997 | Farrington et al. | |
| 5,667,636 | A | 9/1997 | Engel et al. | |
| 5,672,248 | A | 9/1997 | Wendt et al. | |
| 5,679,218 | A | 10/1997 | Vinson et al. | |
| 5,746,887 | A | 5/1998 | Wendt et al. | |
| 5,772,845 | A | 6/1998 | Farrington et al. | |
| 5,846,380 | A | 12/1998 | Van Phan et al. | |
| 5,888,347 | A | 3/1999 | Engel et al. | |
| 5,932,068 | A | 8/1999 | Farrington et al. | |
| 6,017,417 | A | 1/2000 | Wendt et al. | |
| 6,027,611 | A | 2/2000 | McFarland et al. | |
| 6,054,020 | A | 4/2000 | Goulet et al. | |
| 6,162,327 | A | 12/2000 | Batra et al. | |
| 6,171,442 | B1 | 1/2001 | Farrington et al. | |
| 6,224,714 | B1 | 5/2001 | Schroeder et al. | |
| 6,231,719 | B1 | 5/2001 | Garvey et al. | |
| 6,274,667 | B1 | 8/2001 | Shannon et al. | |
| 6,287,418 | B1 | 9/2001 | Schroeder et al. | |
| 6,365,667 | B1 | 4/2002 | Shannon et al. | |
| 6,398,910 | B1 | 6/2002 | Burazin et al. | |
| 6,998,017 | B2 * | 2/2006 | Lindsay et al. | 162/109 |
| 7,147,751 | B2 * | 12/2006 | Shannon et al. | 162/135 |
| 2003/0056917 | A1 * | 3/2003 | Jimenez | 162/158 |
| 2003/0201081 | A1 * | 10/2003 | Drew et al. | 162/111 |
| 2004/0020614 | A1 * | 2/2004 | Lindsay et al. | 162/109 |
| 2006/0243405 | A1 * | 11/2006 | Zwick et al. | 162/135 |

FOREIGN PATENT DOCUMENTS

WO WO 2005031068 A1 * 4/2005

OTHER PUBLICATIONS

TAPPI Provisional Method T 530 pm-89, "Size Test for Paper By Ink Resistance (Hercules Method)," published by the TAPPI Press, Atlanta, Georgia, revised 1989, pp. 1-5.

* cited by examiner

*Primary Examiner*—José A Fortuna
(74) *Attorney, Agent, or Firm*—Gregory E. Croft

(57) ABSTRACT

Tissues having a high level of softness and hand protection in combination with improved cleaning are disclosed. The tissues have been shown to remove more mucus than commercially available tissues.

15 Claims, 5 Drawing Sheets

SOFT PAPER SHEET WITH IMPROVED MUCUS REMOVAL

BACKGROUND OF THE INVENTION

Softness is a key consumer attribute of facial tissue. It is known that enhanced softness can be developed with the topical application of a polysiloxane. For nose care applications, an additional benefit to polysiloxanes can be the hydrophobicity that the polysiloxane imparts to the tissue sheet. While hydrophobicity, in general, can be an undesirable attribute for an absorbent tissue for nose care applications, such hydrophobicity can be perceived as a consumer benefit in preventing the passage of nasal secretions through the tissue and onto the users hand.

While polysiloxanes can greatly enhance the softness attributes of the tissue, as well as the ability of the tissue to protect the user's hand, the ability of the tissue sheet to remove mucus and similar high viscosity materials can be reduced by application of the polysiloxane. As such, tissues treated with polysiloxane may have a reduced cleaning capability relative to an untreated tissue.

Hence, there is a need to manufacture soft tissues that have a high degree of softness and hand protection while also having the ability to effectively remove mucus from the user's nose. The effective removal of mucus from the user's nose may not only provide a cosmetic benefit in helping to clean the skin but may also provide a clinical benefit in assisting in removal of skin irritants present in the mucus. Thus, a tissue that is more soothing may also be achieved.

SUMMARY OF THE INVENTION

It has now been discovered that paper sheets having specific topographic features and treated with a polysiloxane have a greater ability to remove mucus than previously possible while also having a high degree of softness. Thus, tissues having a high level of softness and hand protection in combination with improved cleaning ability can be produced. Such tissues have been shown to remove more mucus than commercially available tissues.

In various embodiments of the invention, the amount of polysiloxane present as polydialkylsiloxane in the tissue paper, as tested by the Polydialkylsiloxane Content test herein, can be about 0.4% or greater, about 0.8% or greater, about 1% or greater, from about 0.4% to about 5%, or from about 0.7% to about 1.3%.

In various embodiments of the invention, the Specific Surface Area ratio, as tested herein, can be about 2.5% or greater, about 4% or greater, about 5% or greater, from about 2.5% to about 10%, from about 2.5% to about 8%, or from about 4% to about 7%.

In various embodiments of the invention, the Specific Surface Volume ratio, as tested herein, about 0.08 $mm^3/mm^2$ or greater, about 0.1 $mm^3/mm^2$ or greater, about 0.12 $mm^3/mm^2$ or greater, about 0.14 $mm^3/mm^2$ or greater, from about 0.08 $mm^3/mm^2$ to about 0.35 $mm^3/mm^2$, from about 0.1 $mm^3/mm^2$ to about 0.25 $mm^3/mm^2$, or from about 0.1 $mm^3/mm^2$ to about 0.2 $mm^3/mm^2$.

In various embodiments of the invention, the Coefficient of Friction, as tested herein, can be less than 0.60, less than 0.56, and less than 0.50, from about 0.50 to 0.60, or from about 0.50 to 0.56.

In various embodiments of the invention, the Mucus Removal, as tested herein, can be about 30% or greater, about 35% or greater, about 40% or greater, from about 30% to about 70%, from about 30% to about 50%, or from about 35% to about 50%.

In various embodiments of the invention, the Hercules Size Test, as tested herein, can be about 7 sec. or greater, about 15 sec. or greater, about 25 sec. or greater, from about 7 sec. to about 50 sec., from about 9 sec. to about 30 sec., or from about 10 sec. to about 25 sec.

In one embodiment, the inventive tissues have a COF less than 0.6 and a Specific Surface Area ratio of about 2.5% or greater. In another embodiment, the inventive tissues have a COF less than 0.6 and a Specific Surface Volume ratio of about 0.08 $mm^3/mm^2$ or greater. In another embodiment, the inventive tissues have a Mucus Removal of about 30% or greater and a COF less than 0.6. In another embodiment, the inventive tissues have a Mucus Removal of about 35% or greater and an HST of about 5 sec. or greater.

TEST METHODS

Coefficient of Friction (COF) Test

Figure 1:
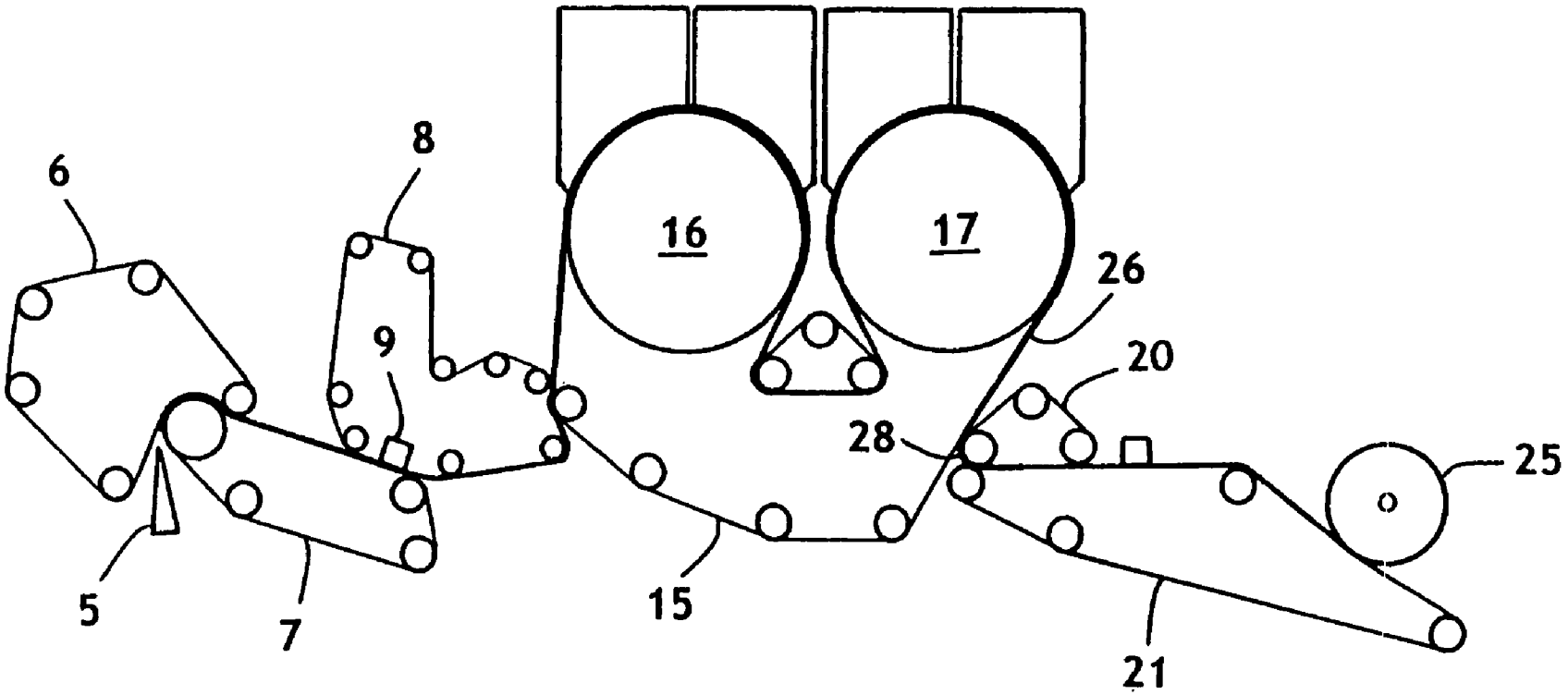
FIG. 1 is a schematic illustration of an uncreped through-dried tissue making process suitable for purposes of making paper in accordance with this invention.

This test is used to measure the kinetic COF of two tissue sheets in sliding contact. The procedure determines the kinetic friction of a first tissue sheet after it has begun to slide over a second tissue sheet. A sled, which has the test specimen attached, is pulled over a platen that has a second tissue sheet attached. The test specimen and tissue on the platen are in surface-to-surface contact with each other. COF is defined as the measure of the relative difficulty when the surface of one material is sliding over an adjoining surface of either itself or of another material. The kinetic COF represents the average COF value obtained as the specimen travels between 0.5 cm (0.2") to 4.5 cm (1.8") away from the beginning point of travel (the first 0.5 cm (0.2") of travel are not used in the averaging) at a testing rate of 15 cm per minute (5.9" per minute). The test measures the machine direction COF of the test specimen relative the machine direction of the second tissue sheet.

The following apparatus and material are required: Coefficient of Friction (COF) tester TMI Model 32-90 or equivalent and a 200±5.0 grams Testing Sled with a 63.5 mm×63.5 mm (2.5 inch×2.5 inch) foam test base, both obtained from Testing Machines, Inc., Islanda, N.Y.

The test specimens are prepared as follows: The test specimens are cut from the outer plies of the tissue sheet. If the product is a single ply, then both the test sled and test bed material will come from the same ply. If the sample or product is multi-ply, the test sled specimen will come from the top outer ply (as presented in the box or roll) and the test bed material will be cut from the bottom outer ply. Cut the test sled specimen from the top tissue ply 120±1 mm (4.72±0.04 in.) in the machine direction (MD) and 67±1 mm (2.64±0.04 in.) in the cross direction (CD). Make a 25.4±10 mm (1±0.39 in.)

centered cut into one of the 67 mm ends of the test sled specimen; this allows the specimen to fit around the guide pin on the test sled. Cut the test bed material from the bottom tissue ply (described above) from the same tissue sheet 305±1 mm (12±0.04 in.) in the machine direction (MD) by approximately 102-127 mm (4-5 in.) wide.

The specimens are tested as follows: Conduct the testing in an atmosphere of 23°±1° C. and 50±2% relative humidity. Condition all specimens a minimum of 24 hours prior to testing. Calibrate the COF tester according to the manufacturer's directions. In the Setup Procedure section, set the kinetic test speed to 15 cm per minute, with a test length of 5 cm. Set the units to COF. Set the portion of the curve to take the average COF on by setting the Default Left CSR to 0.5 cm and the Default Right CSR to 4.5 cm. Name the procedure Kinetic COF.

For single ply samples, the tissue sheet is mounted to the test sled with the air side of the sheet facing down (so that the air side will be in surface contact with the test bed material) using the clamps on the test sled. The test bed material is mounted on the testing surface with the air side down (so that the dryer side will be in contact with the test sled specimen) using double-sided adhesive tape. Ensure the test bed material is not wrinkled after securing with the tape. In the case of multi-ply sheets, the test sled ply (the top ply as it comes out of the box or off the roll) is mounted to the test sled using the clamps on the test sled with the outer sheet surface (the surface intended for skin contact during use) facing down so that it will be in contact with the test bed material. The test bed ply (the bottom ply as it comes out of the box or off the roll) is mounted to the test bed with double-sided adhesive tape so that the outer sheet surface (the surface intended for skin contact during use) is facing up so it will be in contact with the test sled ply. Ensure the surfaces of the test specimens and test bed materials are not contaminated during mounting or are wrinkled. Run the test selecting the Kinetic COF procedure in the Run Test mode of the tester, and press the START button.

The results are calculated and displayed by the COF tester. The COF tester records the "KINETIC" value obtained from the average of the values obtained between 0.5 cm and 4.5 cm away from the beginning of the test. The calculation for "KINETIC" coefficient of friction is obtained by the tester using the following equation: $\mu_k = A_s/B$, where $\mu_k$=the kinetic coefficient of friction value, $A_s$=the average gram value obtained over the 4 cm travel, and B=sled weight of 200 grams. A total of five (5) test specimens are tested, as described above, ensuring that a new test specimen and test bed specimen is used for each test. The five individual results are averaged and reported for the final result.

Hercules Size Test (HST)

The "Hercules Size Test" (HST) is a test that generally measures how long it takes for a liquid to travel through a tissue sheet. Hercules size testing was done in general accordance with TAPPI method T 530 PM-89, *Size Test for Paper with Ink Resistance*. Hercules Size Test data was collected on a Model HST tester using white and green calibration tiles and the black disk provided by the manufacturer. A 2% Napthol Green N dye diluted with distilled water to 1% was used as the dye. All materials are available from Hercules, Inc., Wilmington, Del.

All specimens were conditioned for at least 4 hours at 23+/−1° C. and 50+/−2% relative humidity prior to testing. The test is sensitive to dye solution temperature so the dye solution should also be equilibrated to the controlled condition temperature for a minimum of 4 hours before testing.

Six (6) tissue sheets as commercially sold (18 plies for a 3-ply tissue product, 12 plies for a two-ply product, 6 plies for a single ply product, etc.) form the specimen for testing. Specimens are cut to an approximate dimension of 2.5×2.5 inches. The instrument is standardized with white and green calibration tiles per the manufacturer's directions. The specimen (12 plies for a 2-ply tissue product) is placed in the sample holder with the outer surface of the plies facing outward. The specimen is then clamped into the specimen holder. The specimen holder is then positioned in the retaining ring on top of the optical housing. Using the black disk, the instrument zero is calibrated. The black disk is removed and 10+/−0.5 milliliters of dye solution is dispensed into the retaining ring and the timer started while placing the black disk back over the specimen. The test time in seconds (sec.) is recorded from the instrument.

Mucus Removal

Mucus removal was measured by wiping the test specimen through simulated mucus. After the wiping sequence, the amount of simulated mucus retained by the specimen is determined. The retained amount is compared to the initial amount and the percentage of the mucus removed by the specimen is determined.

The following materials are required: Gardner Abrasion Tester model number AG-8100 available from BYK-Gardner USA. Test sled 173 gram+/−10 grams, 68 mm wide by 93 mm long made from acrylic plastic, such as PLEXIGLASS. Bottom test surface of polycarbonate, such as LEXAN, 460 mm long by 172 mm wide by 5.7 mm thick.

Simulated Mucus

The simulated mucus used as the test fluid has been developed to have a shear thinning viscosity similar to typical nasal discharge. It is prepared according to the following directions. Materials: 2.70 g Carboxymethyl Cellulose (CMC), 0.75 g methyl paraben (MP) and 500 ml distilled water. Equipment: 1000 ml beaker, hot plate, thermometer, 40-ounce commercial blender, and a stop watch.

Procedure: Heat 500 ml of distilled water to 55° C. Pour 400 ml of heated water into the blender. Replace rubber portion of cover onto blender. Slowly add approximately ⅓ of MP. Blend the mixtures at a medium blender speed and slowly add remaining MP. Next, add the CMC. Then add the remaining 100 ml of heated water. Continue blending for 2 minutes. Store the simulated mucus in a covered plastic container. Allow solution to equalize to the testing conditions before use. All specimens and the simulated mucus were conditioned for at least 4 hours at 23+/−1° C. and 50+/−2% relative humidity prior to testing.

Specimen Preparation

The test specimens are prepared as follows: A tissue sheet as commercially sold (3plies for a 3-ply tissue product, 2 plies for a two-ply product, 1 ply for a single ply product, etc.) is cut to 3" (7.6 cm) wide in the cross machine direction by 8" (20.3 cm) long in the machine direction. The specimen is then wrapped around the sled with the machine direction of the specimen aligned with the longer dimension of the test sled. The ends of the specimen are wrapped around the test sled such that the specimen is tight against the bottom of the test sled. The ends of the specimen are then taped to the top of the test sled. Ensure that the bottom of the sled, which will contact the test surface and the fluid, is one continuous piece of the tissue specimen.

Test Procedure

Turn on the Gardner Abrasion Tester and allow the unit to warm up for 15 minutes prior to testing. Set the number of testing cycles to 1 on the front panel of the unit. Place the bottom test surface in the tray beneath the test sled. Weigh the test sample and test sled to an accuracy of +/−0.01 g. Wipe the bottom test surface clean using a paper towel ensuring that any simulated mucus from a prior test is thoroughly removed. Place 0.5 g +/−0.01 g of synthetic mucus in the center of the bottom test surface using a pipette. Place the test sled with the attached specimen on the bottom test surface approximately 5 cm (2") to the right of the synthetic mucus insult with the specimen contacting the bottom test surface. Start the tester, ensuring that the test sled with specimen travels at 12.3 inches per second (31.2 cm per second) over the test surface. The sled travels back and forth through the insult one time. The specimen and test sled are immediately removed from the abrasion tester and weighed. Subtract the pre-test weight of the specimen and test sled to determine the weight of synthetic mucus removed by the specimen. Divide this weight by the 0.5 g insult size and multiply by 100 to determine the mucus removal efficiency as a percent (%). Ten (10) samples are tested following the above procedure and the average of the ten samples is recorded as the mucus removal efficiency.

Polydialkylsiloxane Content

The polydimethylsiloxane (PDMS) content on cellulose fiber substrates was determined using the following procedure. A sample containing polydimethylsiloxane is placed in a headspace vial, boron trifluoride reagent is added, and the vial sealed. After reacting for about fifteen minutes at about 100° C., the resulting diflourodimethyl siloxane (DFDMS) in the headspace of the vial is measured by gas chromatography with an FID detector.

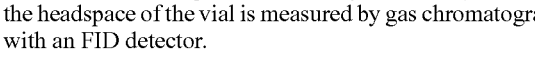

$$3Me_2SiO+2BF_3\cdot O(C_2H_5)_2 \rightarrow 3Me_2SiF_2+B_2O_3+2(C_2H_5)_2O$$

The method described herein was developed using a Hewlett-Packard Model 5890 Gas Chromatograph with an FID and a Hewlett-Packard 7964 autosampler. An equivalent gas chromatography system may be substituted.

The instrument was controlled by, and the data collected, using Perkin-Elmer Nelson Turbochrom software (version 4.1). An equivalent software program may be substituted. A J&W Scientific GSQ (30 m×0.53 mm i.d.) column with film thickness 0.25 μm, Cat. #115-3432 was used. An equivalent column may be substituted.

The gas chromatograph was equipped with a Hewlett-Packard headspace autosampler, HP-7964 and set up at the following conditions:

| | |
|---|---|
| Bath Temperature: 100° C. | Loop Temperature: 110° C. |
| Transfer Line Temperature: 120° C. | GC Cycle Time: 25 minutes |
| Vial Equilibrium Time: 15 minutes | Pressurize Time: 0.2 minutes |
| Loop Fill Time: 0.2 minutes | Loop Equil. Time: 0.05 minutes |
| Inject Time: 1.0 minute | Vial Shake: 1 (Low) |

The gas chromatograph was set to the following instrument conditions:

Carrier gas: Helium

Flow rate: 16.0 mL through column and 14 mL make-up at the detector.

Injector Temperature: 150° C.

Detector Temperature: 220° C.

Chromatography Conditions:

50° C. for 4 minutes with a ramp of 10° C./minute to 150° C.

Hold at final temperature for 5 minutes.

Retention Time: 7.0 min. for DFDMS

Preparation of Stock Solution

The method is calibrated to pure PDMS using DC-200 fluid available from Dow Corning, Midland, Mich. A stock solution containing about 1250 μg/ml of the DC-200 fluid is prepared in the following manner. About 0.3125 grams of the DC-200 fluid is weighed to the nearest 0.1 mg into a 250-ml volumetric flask. The actual weight (represented as X) is recorded. A suitable solvent such as methanol, MIBK or chloroform is added and the flask is swirled to dissolve/disperse the fluid. When dissolved, the solution is diluted to volume with solvent and mixed. The ppm of dimethylpolysiloxane (represented as Y) is calculated from the following equation: PPM of dimethylpolysiloxane (Y)=X/0.250.

Preparation of Calibration Standards

The Calibration Standards are made to bracket the target concentration by adding 0 (blank), 50, 100, 250, and 500 μL of the Stock Solution (the volume in uL $V_C$ recorded) to successive 20 mL headspace vials containing 0.1±0.001 grams of an untreated control tissue web or tissue product. The solvent is evaporated by placing the headspace vials in an oven at a temperature ranging between about 60° C. to about 70° C. for about 15 minutes. The μg of dimethylpolysiloxane (represented as Z) for each calibration standard is calculated from the following equation: Z=Vc*Y/1000.

Analytical Procedure

The calibration standards are then analyzed according to the following procedure: 0.100±0.001 g of tissue sample is weighed to the nearest 0.1 mg into a 20-ml headspace vial. The sample weight (represented as $W_S$) in mg is recorded. The amount of tissue web and/or tissue product taken for the standards and samples must be the same. 100 μL of $BF_3$ reagent is added to each of the samples and calibration standards. Each vial is sealed immediately after adding the $BF_3$ reagent. The sealed vials are placed in the headspace autosampler and analyzed using the conditions described previously, injecting 1 mL of the headspace gas from each tissue sample and standard.

Calculations

A calibration curve of μg dimethylpolysiloxane versus analyte peak area is prepared. The analyte peak area of the tissue sample is then compared to the calibration curve and amount of polydimethylsiloxane (represented as (A)) in μg on the tissue web and/or tissue product is determined. The amount of polydimethylsiloxane (represented as (C)) in percent by weight on the tissue sample is computed using the following equation: $(C)=(A)/(W_S*10^4)$. The amount of the polydimethylsiloxane (represented as (D)) in percent by weight on the tissue sample is computed using the following equation: (D)=(C)/100.

When polydialkylsiloxanes other than dimethylpolysiloxane are present, calibration standards are made from representative samples of the pure polydialkylsiloxanes that are present and the amount of each polydialkylsiloxane is determined as in the method above for polydimethylsiloxane. The sum of the individual polydialkylsiloxane amounts is then used for the total amount of polydialkylsiloxane present in the tissue web and/or tissue product.

Specific Surface Area Ratio and Specific Surface Volume Ratio

The values for Specific Surface Volume ratio and Specific Surface Area ratio are based on a 3-dimensional topography analysis (surface profiles), which are well defined in *Assessment Surface Topograhpy*, Liam Blunt et al, ed., Kogan Page Publishers ISBN 1-9039-9611-2 and herein incorporated by reference. The Specific Surface Volume ratio (Smvr) is the ratio of the total volume of space above the measured surface relative to the analysis area expressed in $mm^3/mm^2$. The volume is obtained by calculating the space between the points of the tissue surface and an imaginary horizontal plane at the maximum altitude of the surface.

The Specific Surface Area ratio (Sdr) is the ratio of the area measured following the surface profile relative to the analysis area expressed as a percent (%). An analogous example would be to measure the surface area of a piece of corrugated paper that has been stretched flat and the surface area that the paper covered prior to stretching it out. Sdr is the ratio of the sheet area stretched flat to the area that the sheet covered prior to stretching. A completely flat surface will have a value near 0%. A complex surface will have a value of some percent.

Materials and Equipment

Form Talysurf Series 2 stylus profilometer available from Taylor-Hobson Precision Ltd., Leicester, England. The instrument is manufactured according to ISO accepted standards for the measurement of surface texture as discussed in the following standards: ISO 3274:1996 Geometrical Product Specifications (GPS)—Surface Texture: Profile method—Nominal characteristics of contact (stylus) instruments; ISO 4287:1997 Geometrical Product Specifications (GPS)—Surface Texture: Profile method—Terms, definitions and surface texture parameters; and ISO 4288:1996 Geometrical Product Specifications (GPS)—Surface Texture: Profile method—Rules and procedures for the assessment of surface texture all three standards herein incorporated by reference.

The profilometer operates with the installed "μltra" software, identified as K510-1038-01. The "μltra" software records the stylus position and generates an x-y-z data set as successive traces by the traverse unit are completed.

The profilometer is equipped with a laser traverse unit containing a diamond tip stylus. The traverse unit uses a laser interferometer to measure elevation (z) as it draws the stylus over the area of interest in a left-to-right direction (x). The stylus is a standard 60 mm arm length with a diamond tip that has a 2 micrometer radius of curvature.

A y-stage accessory is used to incrementally move the tissue in the y-direction after a trace in the x-direction is completed by the traverse unit.

TalyMap Universal version 2.0.20 software is used for performing calculations on the profilometer data sets.

The sample preparation equipment includes 2-inch×3-inch glass microscope slides and 2-inch wide strip of double-sided adhesive tape, such as SCOTCH brand adhesive tape.

Sample Preparation and Handling

One representative sample was prepared from each tissue tested for stylus profilometry.

1. Cut out a representative 45 mm by 45 mm square area of a tissue avoiding areas of discrete, large scale embossing patterns and place the side to be analyzed facing down on a clean, smooth, hard surface.
2. Attach a 2-inch wide strip of the double-sided adhesive tape onto a 2-inch by 3-inch glass microscope slide, ensuring that there are no bubbles or wrinkles in the tape.
3. Orient the slide, tape side down, and gently drop from about a ½ inch height onto the cut tissue sample.
4. Apply minimal pressure, just enough to attach the tissue to the glass slide, so as not to deform the delicate structures.
5. Take care not to touch the mounted tissue sample on the glass slide.
6. For single-ply bath tissues, ensure the surface facing the outside of the roll is facing away from the glass slide after mounting.
7. For all two- and multi-ply facial and bath tissues, mount only a single-ply ensuring that the outside facing surface, the surface intended to be used against a person's skin, is facing away from the glass slide after mounting.

Data Collection

1. Attach the glass slide containing the sample to the y-stage with the test surface facing the stylus. Masking tape can be applied over two opposite corners of the slide. For consistency, orient the sample so that machine direction of the sample is parallel with the x-direction, the direction of stylus travel.
2. Select a 26 mm by 26 mm square area to be scanned and set the stylus to the starting point.
3. Avoid embossed areas in favor of areas with uniform background patterns or textures.
4. Room temperature and humidity were not controlled to TAPPI standards during profilometry testing. The testing was performed under ambient conditions in a climate controlled office environment.
5. Refer to the Taylor-Hobson—μltra operator's manual for locations of hardware controls, icons and menu commands.
6. The x-position (left-right) and vertical height (z) of the stylus are adjusted either with the stage controller joystick or icons on the μltra user interface. The y-position is controlled only by the y-stage icons on the μltra user interface.
7. Raise or lower the stylus so that it is positioned about 1 inch above the sample surface.
8. Adjust the X position of the stylus and the Y position of the stage so that, when looking down on the sample surface, the stylus is located at the lower left corner of the area to be scanned.
9. Lower the stylus until it almost touches the surface and click the contact icon in the z-control icon set.
10. Select 3D measurement from the Measure and Analyze menu.
11. Enter the "Y Start Position"=the current position of the y-stage (see the Instrument Status sub-window)
12. Enter the "Y End Position"=(current position plus 26 millimeters)
13. "Specify in Points (Y)" option is checked
14. Enter "Number of Points (Y)"=256
15. Confirm that "Immediate" option is checked
16. Enter "Data Length"=26 millimeters
17. Select "Measurement Speed"=0.5 mm/sec
18. Enter "Number of Points"=256
19. Click the OK button.
20. At the screen prompt, select a file name and folder and confirm that the format is "SUR".

21. Click the "Save" button (Data acquisition (scanning time) is approximately 4 hours)
22. Click "OK" on the screen prompt at the conclusion of the scan.

Data Processing and Analysis

1. Upon completion of the data acquisition, start the Talymap Universal software program.
2. Select "Open a Studiable . . . " from the File Menu and select the saved file.
3. Select the "Leveling" option from the "Operators" menu (this operation calculates any planar slope and adjusts it to zero). At the command prompt:
   Select "User Defined" in Type of Area
   Select "Include All" in "Operation on the Area"
   Click "OK"
4. Select the "Form Removal" option from the "Operators" menu (this operation identifies large-scale features (form) and calculates a polynomial function that defines a surface that fits the features. A $10^{th}$ order polynomial was chosen. At the command prompt:
   Select "User Defined" in Type of Area
   Select "Include All" in "Operation on the Area"
   Select "Polynomial of order" and "10" in "Form to remove"
   Select "Surface, Form Removed" in "Results to Provide"
   Click "OK"
5. Select the "Zoom . . . " option from the "Operators" menu. This operation is used to crop the scanned area to a desired size. Use this operator four times in succession to subdivide the 1-inch by 1-inch "map" into 4 equal ½ inch by ½ inch maps. At the command prompt:
   Confirm that the outlined area to be cropped equals ½ the width and height of the original map.
   Use the mouse cursor to move the outline to the upper left corner of the map.
   Click "OK"
6. Repeat Step 5 for the other three quadrants.
7. Select a ½ inch map by clicking on it with the mouse cursor.
8. Select "Parameters" from the "Studies" menu. A set of parameters characterizing the selected map will appear in a display.
   Click on the "calculator" icon to display a sub-window for adding or deleting parameters
   Click on "Remove all" to clear the Selected Parameters list
   Select "All Parameters" from the drop-down menu at the bottom of the sub-window
   Select Sdr from the Parameters list and click on Copy
   Select Smvr from the Parameters list and click on Copy
   Click "OK"
9. Select "Parameters" from the "Studies" menu for all subsequent ½ inch maps to automatically display Sdr and Smvr. This provides four (4) values for the parameters Specific Surface Area ratio, Sdr, and the Specific Surface Volume ratio, Smvr, for each tissue sample.
10. Calculate and record the average value for Sdr and Smvr for each sample tested.

DETAILED DESCRIPTION

FIG. 1 is a schematic illustration of an uncreped through-dried process useful for making paper suitable for purposes of this invention. In particular, shown is an uncreped through-air-dried tissue making process in which a headbox 5 deposits an aqueous suspension of papermaking fibers between forming wires 6 and 7. The headbox can be configured to form either a blended paper web having a homogeneous structure or deposit two, three, or more layers forming a layered single ply web. In a layered configuration, the aqueous suspension of papermaking fibers emitted by the headbox in the various layers can vary in consistency or fiber composition from adjacent layers.

The newly-formed paper web is transferred to a slower moving transfer fabric 8 with the aid of a vacuum box 9. The paper web is then transferred to a throughdrying fabric 15 and passed over one or more throughdryers 16 and 17 to dry the web.

After drying, the paper web is transferred from the throughdrying fabric 15 to fabric 20 and thereafter briefly sandwiched between fabrics 20 and 21. The dried paper web remains with fabric 21 until it is wound up into a softroll 25. Further description of the paper making process and fabrics useful for making the paper of the present invention is found in U.S. Pat. No. 5,607,551 issued to Farrington et al. on Mar. 4, 1997; U.S. Pat. No. 5,656,132; issued to Farrington et al. on Aug. 12, 1997; U.S. Pat. No. 5,667,636 issued to Engel et al. on Sep. 16, 1997; U.S. Pat. No. 5,672,248 issued to Wendt et al. on Sep. 30, 1997; U.S. Pat. No. 5,746,887 issued to Wendt et al. on May 5, 1998; U.S. Pat. No. 5,772,845 issued to Farrington et al. on Jun. 30, 1998; U.S. Pat. No. 5,888,347 issued to Engel et al. on Mar. 30, 1999; U.S. Pat. No. 5,932,068 issued to Farrington et al. on Aug. 3, 1999; U.S. Pat. No. 6,017,417 issued to Wendt et al. on Jan. 25, 2000; U.S. Pat. No. 6,171,442 issued to Farrington et al. on Jan. 9, 2001; and U.S. Pat. No. 6,398,910 issued to Burazin et al. on Jun. 4, 2002, all of which are commonly assigned to Kimberly-Clark Worldwide, Inc. and all herein incorporated by reference.

Figure 2:
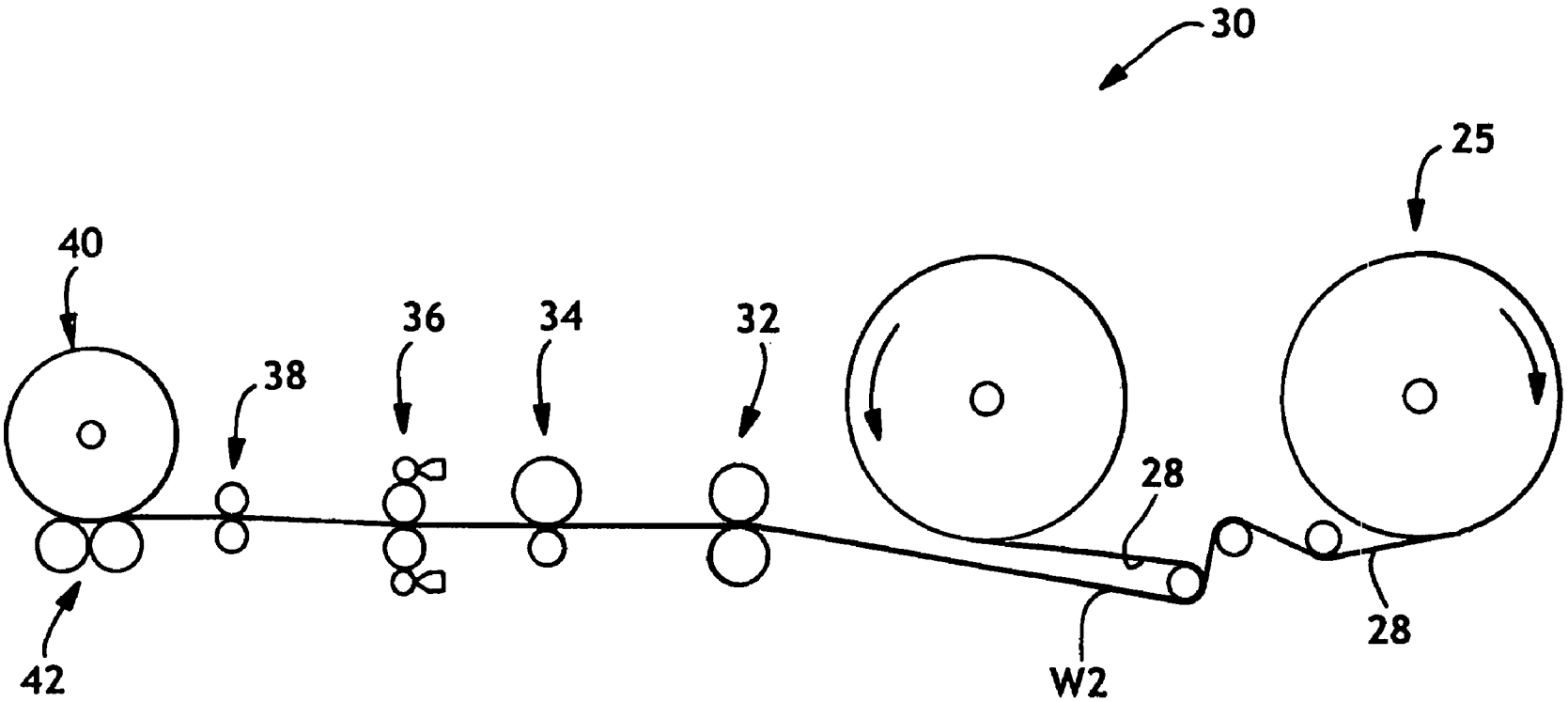
FIG. 2 is a schematic illustration of a converting operation for the tissue produced by the process of FIG. 1.

Referring now to FIG. 2, a converting line 30 is schematically illustrated. The rewinding machine plies together two softrolls 25 produced from the process illustrated in FIG. 1. A web is drawn from each of the two softrolls and positioned in a face-to-face relationship, creating two-ply web W2. The tissue web produced from the process illustrated in FIG. 1 has an air side 26 that is exposed during through drying and a fabric side 28 that is in contact with the through drying fabric. Either side of the paper web may be placed in a face-to-face relationship with the other paper web. Thus, a two-ply web having both fabric sides exposed, both air sides exposed, or one fabric side and one air side exposed can be made. In one embodiment, the two-ply web had both fabric sides exposed as illustrated.

The two-ply web passes through a calender 32 or multiple calenders. The calender can utilize metallic non-compressive rolls; compressive rolls such as urethane, paper, rubber, or composite; or use a combination of a non-compressive roll with a compressive roll. The calendar can be operated in a nipped condition to a fixed load, or in a gap mode to a fixed gap, or in a gap mode with one of the rolls traveling at a rate faster than the web's speed.

After calendering, the two-ply web passes through a crimping station 34. The crimping station includes an anvil roll and a plurality of crimping wheels. The crimping wheels emboss the two-ply web such that the plies become attached to one another.

After crimping, the two-ply web passes through a gravure coater 36. The coater can apply a topical solution or lotion, such as a polysiloxane composition, to either or both exterior surfaces of the two-ply web. Polysiloxane treated tissue sheets are described in U.S. Pat. No. 4,950,545 issued to Walter et al. on Aug. 21, 1990.; U.S. Pat. No. 5,227,242 issued to Walter et al. on Jul. 13, 1993; U.S. Pat. No. 5,558,873 issued to Funk et al. on Sep. 24, 1996.; U.S. Pat. No. 6,054,020 issued to Goulet et al. on Apr. 25, 2000; and in U.S. Pat.

No. 6,231,719 issued to Garvey et al. on Apr. 25, 2000, the disclosures of each herein incorporated by reference.

In various embodiments of the invention, the amount of polysiloxane present in the tissue paper as tested by the Polydialkylsiloxane Content test above can be about 0.4% or greater, about 0.8% or greater, about 1% or greater, from about 0.4% to about 5%, or from about 0.7% to about 1.3%.

Polysiloxanes encompass a very broad class of compounds. It is understood that the term "polysiloxane composition" as used herein refers to neat polysiloxane or mixtures of polysiloxanes and polysiloxanes in combination with other components. They are character-ized in having a backbone structure:

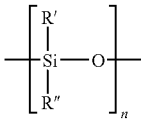

where R' and R" may be a broad range of organo and non-organo groups including mixtures of such groups and where n is an integer≧2. These polysiloxanes may be linear, branched, or cyclic. They may include a wide variety of polysiloxane copolymers containing various compositions of functional groups, hence, R' and R" actually may represent many different types of groups within the same polymer molecule. The organo or non-organo groups may be capable of reacting with pulp fibers to covalently, ionically or hydrogen bond the polysiloxane to the pulp fibers. These functional groups may also be capable of reacting with themselves to form crosslinked matrixes with the pulp fibers.

The scope of the present invention should not be construed as limited by a particular polysiloxane structure, so long as that polysiloxane structure delivers the necessary tissue product benefits to the tissue web and/or the final tissue product. The term "polydialkylsiloxanes" as used herein refers to the portion of the polysiloxane molecule as defined above wherein R' and R" are $C_1$-$C_{30}$ aliphatic hydrocarbon groups. In one embodiment of the present invention, R' and R" may be methyl groups forming so called polydimethylsiloxane units. Functionalized polysiloxanes containing polydialkylsiloxane units may be used for the purposes of the present invention. A variety of functional groups may be present on the polymer besides the dialkylsiloxane units. A combination of polysiloxanes may also be used to create the desired products. For example an aminofunctional polysiloxane may be combined with an epoxyglycol-co-polyether polysiloxane. Examples of such materials are the DC-8500 and DC-8600 fluids commercially available from Dow Corning, Midland, Mich.

In another embodiment of the present invention, all or a portion of the polysiloxane may be selected from the group of so called "amino functional" functional polysiloxanes of the general formula:

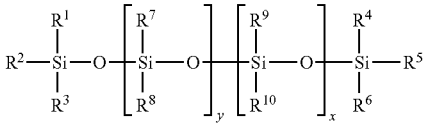

Wherein, x and y are integers>0. The mole ratio of x to (x+y) may be from about 0.005 percent to about 30 percent. The $R^1$-$R^6$ moieties may be independently any monovalent organic group including $C_1$ or higher alkyl groups, ethers, polyethers, polyesters, amines, imines, amides, or other functional groups including the alkyl and alkenyl analogues of such groups, a hydroxyl group or an alkoxy group. $R^7$ and $R^8$ and $R^9$ may be independently a $C_1$-$C_{30}$ aliphatic hydrocarbon group. The $R^{10}$ moiety may be an amino functional hydrocarbon moiety including but not limited to primary amine, secondary amine, tertiary amines, quaternary amines, heterocyclic amines, unsubstituted amides and mixtures thereof. An exemplary $R^{10}$ moiety may contain one amine group per constituent or two or more amine groups per substituent, separated by a linear or branched alkyl chain of $C^1$ or greater. The $R^{10}$ group may contain heterocyclic rings, amphiphilic groups or other functionality in addition to the nitrogen functionality. Exemplary materials include DC 2-8220 and DC 2-8182 commercially available from Dow Corning, Inc., Midland, Mich. and Y-14344 available from Crompton, Corp., Greenwich, Conn.

Another class of functionalized polysiloxanes that may be suitable for use in the present invention is the polyether polysiloxanes. They may be used alone or in conjunction with other polysiloxanes such as the aforementioned amino-functional polysiloxanes. Such polysiloxanes generally may have the following structure:

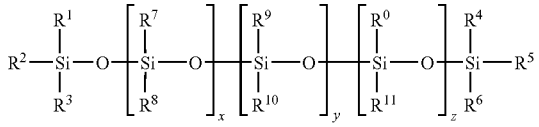

wherein, x and z are integers>0. y is an integer≧0. The mole ratio of x to (x+y+z) may be from about 5 percent to about 95 percent. The ratio of y to (x+y+z) may be from about 0 percent to about 25 percent. The $R^0$-$R^6$ moieties may be independently —OH, alkoxy or any organofunctional group including $C_1$ or higher alkyl groups, ethers, polyethers, polyesters, amines, imines, amides, or other functional groups including the alkyl and alkenyl analogues of such groups. $R^7$ and $R^8$ may be $C_1$-$C_{30}$ aliphatic alkyl groups including mixtures of these groups. The $R^{10}$ moiety may be an amino functional moiety including, but not limited to, primary amine, secondary amine, tertiary amines, quaternary amines, unsubstituted amides, and mixtures thereof. An exemplary $R^{10}$ moiety may contain one amine group per constituent or two or more amine groups per substituent, separated by a linear or branched alkyl chain of $C^1$ or greater. $R^{11}$ may be a polyether functional group having the generic formula: $—R^{12}—(R^{13}—O)_a—(R^{14}O)_b—R^{15}$, wherein $R^{12}$, $R^{13}$, and $R^{14}$ may be independently $C_{1-4}$ alkyl groups, linear or branched; $R^{15}$ may be H or a $C_{1-30}$ alkyl group; and, "a" and "b" are integers of from about 1 to about 100, more specifically from about 5 to about 30. $R^{10}$ may also be an epoxy functional group or a polyhydroxy functional group used in combination with a polyether functional group. The ratios of polyether, epoxy, polyhydroxy and amine groups may be controlled to give the specific product benefits of the present invention.

The amount of polydialkylsiloxane in the tissue web and/or tissue product may be determined by conversion of the polydialkylsiloxane components to the diflourodialkylsilanes with boron triflouride as previously discussed. The amount of diflourodialkylsilane may be measured using gas chromatography to determine the total amount of polydialkylsiloxane in the tissue web and/or tissue product.

While not wishing to be bound by theory, the softening benefits that polysiloxanes and polysiloxane compositions deliver to pulp fiber containing tissue webs and/or tissue products is believed to be, in part, related to the molecular weight of the polysiloxane. Viscosity is often used as an indication of molecular weight of the polysiloxane as exact number or weight average molecular weights are often difficult to determine. In various embodiments of the present invention where the intent is to deliver softness benefits through use of the polysiloxane and/or polysiloxane compositions, the viscosity of the polysiloxanes is about 25 centipoise or greater, in another embodiment of the present invention, about 50 centipoise or greater, and in still another embodiment of the present invention, about 100 centipoise or greater. The term "viscosity" as referred to herein refers to the viscosity of the neat polysiloxane itself and not to the viscosity of an emulsion and/or composition if so delivered. It should also be understood that the polysiloxanes of the present invention may be delivered as solutions containing diluents. Such diluents may lower the viscosity of the solution below the limitations set above, however, the efficacious part of the polysiloxane should conform to the viscosity ranges given above. Examples of such diluents include but are not limited to oligomeric and cyclo-oligomeric polysiloxanes such as octamethylcyclotetrasiloxane, octamethyltrisiloxane, decamethylcyclopentasiloxane, decamethyltetrasiloxane and the like, including mixtures of these compounds.

Optional chemical additives may also be added to the tissue web or sheet to impart additional benefits to the tissue web and/or tissue product and process and are not antagonistic to the intended benefits of the present invention. The following materials are included as examples of additional chemical additives that may be applied to the tissue web and/or tissue products of the present invention. The chemical additives are included as examples and are not intended to limit the scope of the present invention. Such chemical additives may be added at any point in the papermaking process, the specific addition point not being critical to the invention. For example, the chemical additive may be applied to the pulp fibers during the pulp making process, to the fibers as they reside in a slurry with water prior to the forming stage, topically to the web after forming but prior to drying, topically to the web during or after drying or by any other method or combination of methods known in the art. This includes addition with any polysiloxane composition that may be present.

Charge promoters and control agents are commonly used in the papermaking process to control the zeta potential of the papermaking furnish in the wet end of the process. These species may be anionic or cationic, most usually cationic, and may be either naturally occurring materials such as alum or low molecular weight high charge density synthetic polymers, typically of molecular weight of about 500,000 or less. Drainage and retention aids May also be added to the furnish to improve formation, drainage and fines retention. Included within the retention and drainage aids are microparticle systems containing high surface area, high anionic charge density materials.

Wet and dry strength agents may also be applied to the tissue web and/or tissue product. As used herein, "wet strength agents" refer to materials used to immobilize the bonds between pulp fibers in the wet state. Typically, the means by which pulp fibers are held together in tissue webs and/or tissue products involve hydrogen bonds and sometimes combinations of hydrogen bonds and covalent and/or ionic bonds. In the present invention, it may be useful to provide a strength agent that will allow bonding of pulp fibers in such a way as to immobilize the fiber-to-fiber bond points and make the pulp fibers resistant to disruption in the wet state. In this instance, the wet state typically means when the tissue web and/or tissue product is largely saturated with water or other aqueous fluids and/or solutions, but could also mean significant saturation with body fluids such as urine, blood, mucus, menses, runny bowel movement, lymph, and other body exudates.

Any strength agent material that when added to a tissue web and/or tissue product results in providing the tissue web and/or tissue product with a mean wet geometric tensile strength:dry geometric tensile strength ratio in excess of about 0.1 will, for purposes of the present invention, be termed a wet strength agent. Typically, these materials are termed either as permanent wet strength agents or as "temporary" wet strength agents. For the purpose of differentiating permanent wet strength agents from temporary wet strength agents, the permanent wet strength agents will be defined as those resins which, when incorporated into tissue webs and/or tissue products, will provide a tissue web and/or tissue product that retains more than 50% of its original wet strength after exposure to water for a period of at least five minutes. Temporary wet strength agents are those which show about 50% or less of their original wet strength after being saturated with water for five minutes. Both classes of wet strength agents find application in the present invention. The amount of wet strength agent added to the pulp fibers may be at least about 0.1 dry weight percent, more specifically about 0.2 dry weight percent or greater, and still more specifically from about 0.1 to about 3 dry weight percent, based on the dry weight of the pulp fibers.

Permanent wet strength agents will typically provide a more or less long-term wet resilience to the structure of a tissue web and/or tissue product. In contrast, the temporary wet strength agents will typically provide tissue web and/or tissue product structures that had low density and high resilience, but will not provide a structure that has long-term resistance to exposure to water or body fluids.

The temporary wet strength agents may be cationic, nonionic or anionic. Such compounds include PAREZ 631 NC and PAREZ 725 temporary wet strength resins that are cationic glyoxylated polyacrylamide available from Cytec Industries (West Paterson, N.J.). This and similar resins are described in U.S. Pat. No. 3,556,932, issued on Jan. 19, 1971 to Coscia et al. and U.S. Pat. No. 3,556,933, issued on Jan. 19, 1971 to Williams et al. Hercobond 1366, manufactured by Hercules, Inc., located at Wilmington, Del., is another commercially available cationic glyoxylated polyacrylamide that may be used in accordance with the present invention. Additional examples of temporary wet strength agents include dialdehyde starches such as COBOND 1000 from National Starch and Chemcial Company, located at Lincolnshire, Ill., and other aldehyde containing polymers such as those described in U.S. Pat. No. 6,224,714, issued on May 1, 2001 to Schroeder et al.; U.S. Pat. No. 6,274,667, issued on Aug. 14, 2001 to Shannon et al.; U.S. Pat. No. 6,287,418, issued on Sep. 11, 2001 to Schroeder et al.; and U.S. Pat. No. 6,365,667, issued on Apr. 2, 2002 to Shannon et al., the disclosures of which are herein incorporated by reference to the extent they are non-contradictory herewith.

Permanent wet strength agents comprising cationic oligomeric or polymeric resins can be used in the present invention. Polyamide-polyamine-epichlorohydrin type resins such as KYMENE 557H sold by Hercules, Inc., located at Wilmington, Del., are the most widely used permanent wet-strength agents and are suitable for use in the present invention. Such materials have been described in the following U.S. Pat. No. 3,700,623, issued on Oct. 24, 1972 to Keim;

U.S. Pat. No. 3,772,076, issued on Nov. 13, 1973 to Keim; U.S. Pat. No. 3,855,158, issued on Dec. 17, 1974 to Petrovich et al.; U.S. Pat. No. 3,899,388, issued on Aug. 12, 1975 to Petrovich et al.; U.S. Pat. No. 4,129,528, issued on Dec. 12, 1978 to Petrovich et al.; U.S. Pat. No. 4,147,586, issued on Apr. 3, 1979 to Petrovich et al.; and U.S. Pat. No. 4,222,921, issued on Sep. 16, 1980 to van Eenam. Other cationic resins include polyethylenimine resins and aminoplast resins obtained by reaction of formaldehyde with melamine or urea. It is often advantageous to use both permanent and temporary wet strength resins in the manufacture of tissue products with such use being recognized as falling within the scope of the present invention.

Dry strength agents may also be applied to the tissue web and/or tissue product without affecting the performance of the disclosed polysiloxane compositions of the present invention. Such materials used as dry strength agents are well known in the art and include but are not limited to modified starches and other polysaccharides such as cationic, amphoteric, and anionic starches and guar and locust bean gums, modified polyacrylamides, carboxymethylcellulose; sugars, polyvinyl alcohol, chitosans, and the like. Such dry strength agents are typically added to a fiber slurry prior to tissue web formation or as part of the creping package. It may at times, however, be beneficial to blend the dry strength agent with the polysiloxane compositions of the present invention and apply the two chemicals simultaneously to the tissue web and/or tissue product.

At times, it may be advantageous to add additional debonders or softening chemistries to a tissue web and/or tissue product. Examples of such debonders and softening chemistries are broadly taught in the art. Exemplary compounds include the simple quaternary ammonium salts having the general formula $(R^{1'})_{4-b}$—$N^+$—$(R^{1''})_b$ $X^-$ wherein $R^{1'}$ is a $C_{1-6}$ alkyl group, $R^{1''}$ is a $C_{14}$-$C_{22}$ alkyl group, b is an integer from 1 to 3 and X— is any suitable counterion. Other similar compounds include the monoester, diester, monoamide and diamide derivatives of the simple quaternary ammonium salts. A number of variations on these quaternary ammonium compounds are known and should be considered to fall within the scope of the present invention. Additional softening compositions include cationic oleyl imidazoline materials such as methyl-1-oleyl amidoethyl-2-oleyl imidazolinium methylsulfate, commercially available as Mackernium DC-183 from McIntyre Ltd., located in University Park, Ill., and Prosoft TQ-1003 available from Hercules, Inc. Such softeners may also incorporate a humectant or a plasticizer such as a low molecular weight polyethylene glycol (molecular weight of about 4,000 daltons or less) or a polyhydroxy compound such as glycerin or propylene glycol.

It may be desirable to treat a tissue web and/or tissue product with additional types of chemical additives. Such chemical additives include, but are not limited to, absorbency aids usually in the form of cationic, anionic, or non-ionic surfactants, humectants and plasticizers such as low molecular weight polyethylene glycols and polyhydroxy compounds such as glycerin and propylene glycol.

Other additives include without limitation, anti-acne actives, antimicrobial actives, antifungal actives, antiseptic actives, antioxidants, cosmetic astringents, drug astringents, biological additives, deodorants, emollients, external analgesics, binders, film formers, fragrances, and other skin moisturizing ingredients known in the art, opacifiers, skin conditioning agents, skin exfoliating agents, skin protectants, sunscreens and the like.

After coating, the two-ply web passes through a slitter 38 and is wound into a two-ply hardroll 40 by a winder 42. Subsequent converting equipment, known to those of skill in the art, can unwind the two-ply hardroll, cut, fold, and package the two-ply web to form a box of facial tissues.

In various embodiments of the invention, the Specific Surface Area ratio, as tested above, can be about 2.5% or greater: about 4% or greater, about 5% or greater, from about 2.5% to about 10%, from about 2.5% to about 8%, or from about 4% to about 7%.

In various embodiments of the invention, the Specific Surface Volume ratio, as tested above, about 0.08 $mm^3/mm^2$ or greater, about 0.1 $mm^3/mm^2$ or greater, about 0.12 $mm^3/mm^2$ or greater, about 0.14 $mm^3/mm^2$ or greater, from about 0.08 $mm^3/mm^2$ to about 0.35 $mm^3/mm^2$, from about 0.1 $mm^3/mm^2$ to about 0.25 $mm^3/mm^2$, or from about 0.1 $mm^3/mm^2$ to about 0.2 $mm^3/mm^2$.

In various embodiments of the invention, the Coefficient of Friction, as tested above, can be less than 0.60, less than 0.56, and less than 0.50, from about 0.50 to 0.60, or from about 0.50 to 0.56.

In various embodiments of the invention, the Mucus Removal, as tested above can be about 30% or greater, about 35% or greater, about 40% or greater, from about 30% to about 70%, from about 30% to about 50%, or from about 35% to about 50%.

In various embodiments of the invention, the Hercules Size Test, as tested above, can be about 7 sec. or greater, about 15 sec. or greater, about 25 sec. or greater, from about 7 sec. to about 50 sec., from about 9 sec. to about 30 sec., or from about 10 sec. to about 25 sec.

Figure 3:
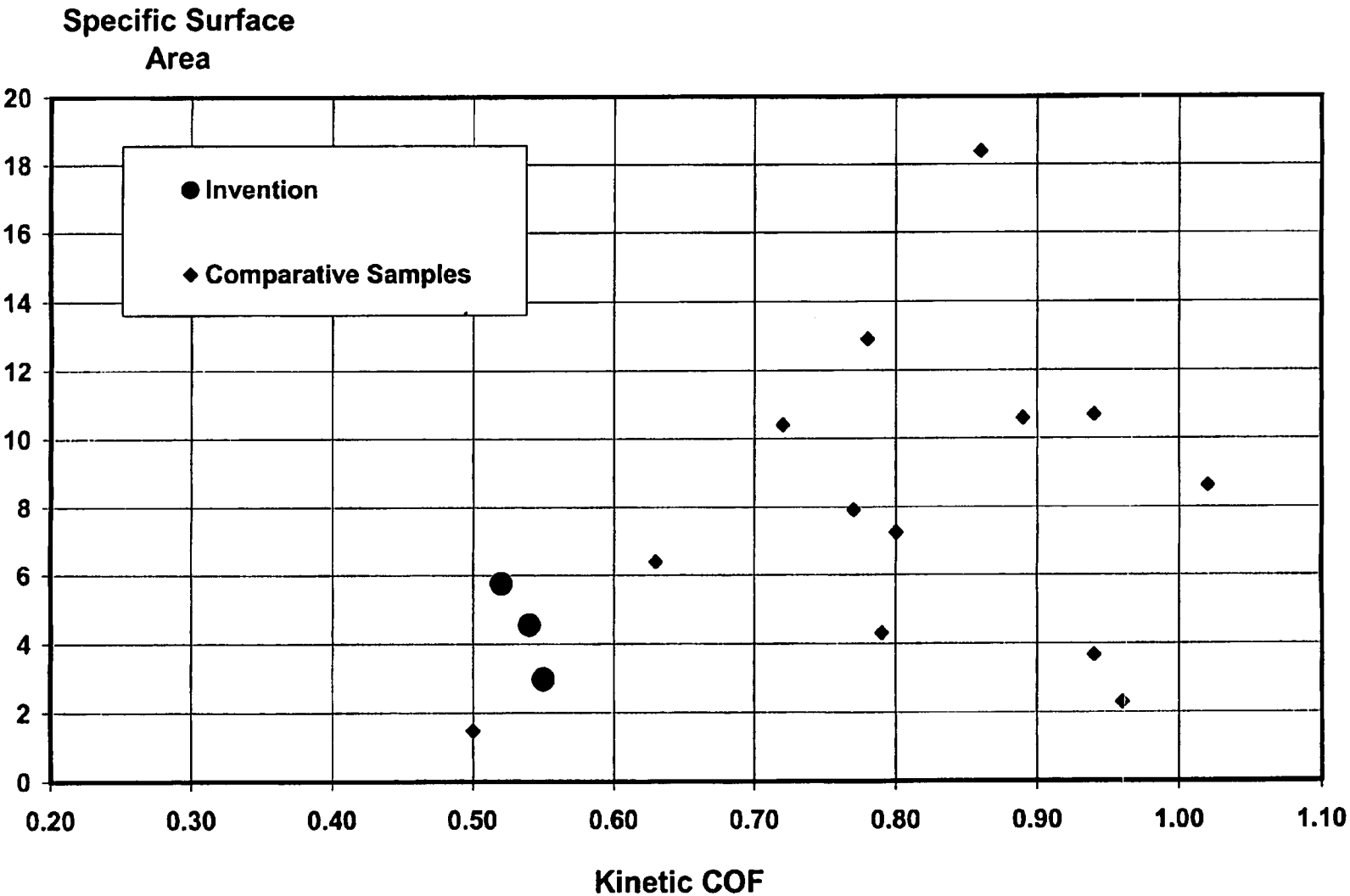
FIG. 3 is a graph of Specific Surface Area ratio vs. Coefficient of Friction.
Figure 4:
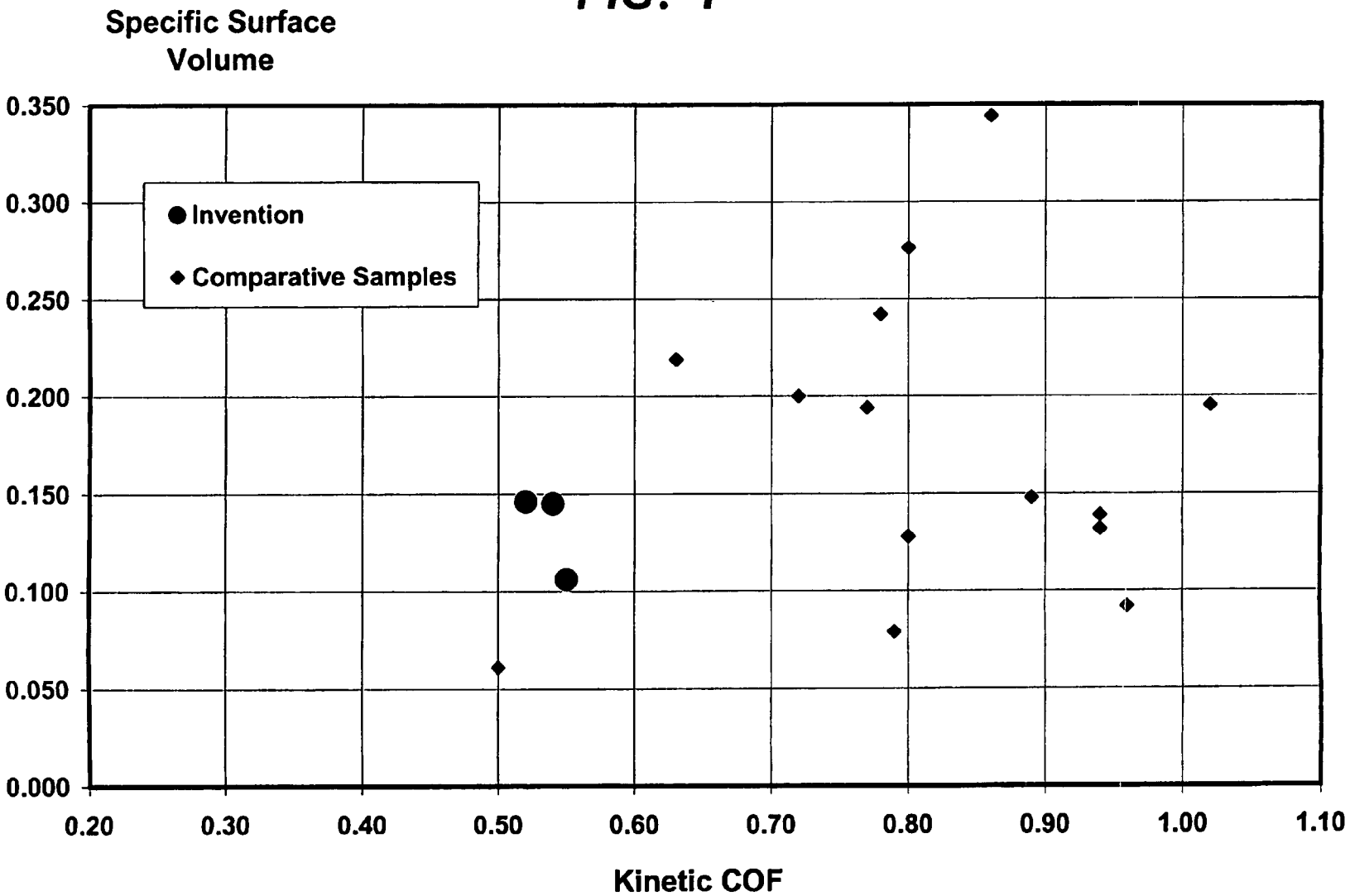
FIG. 4 is a graph of Specific Surface Volume ratio vs. Coefficient of Friction
Figure 5:
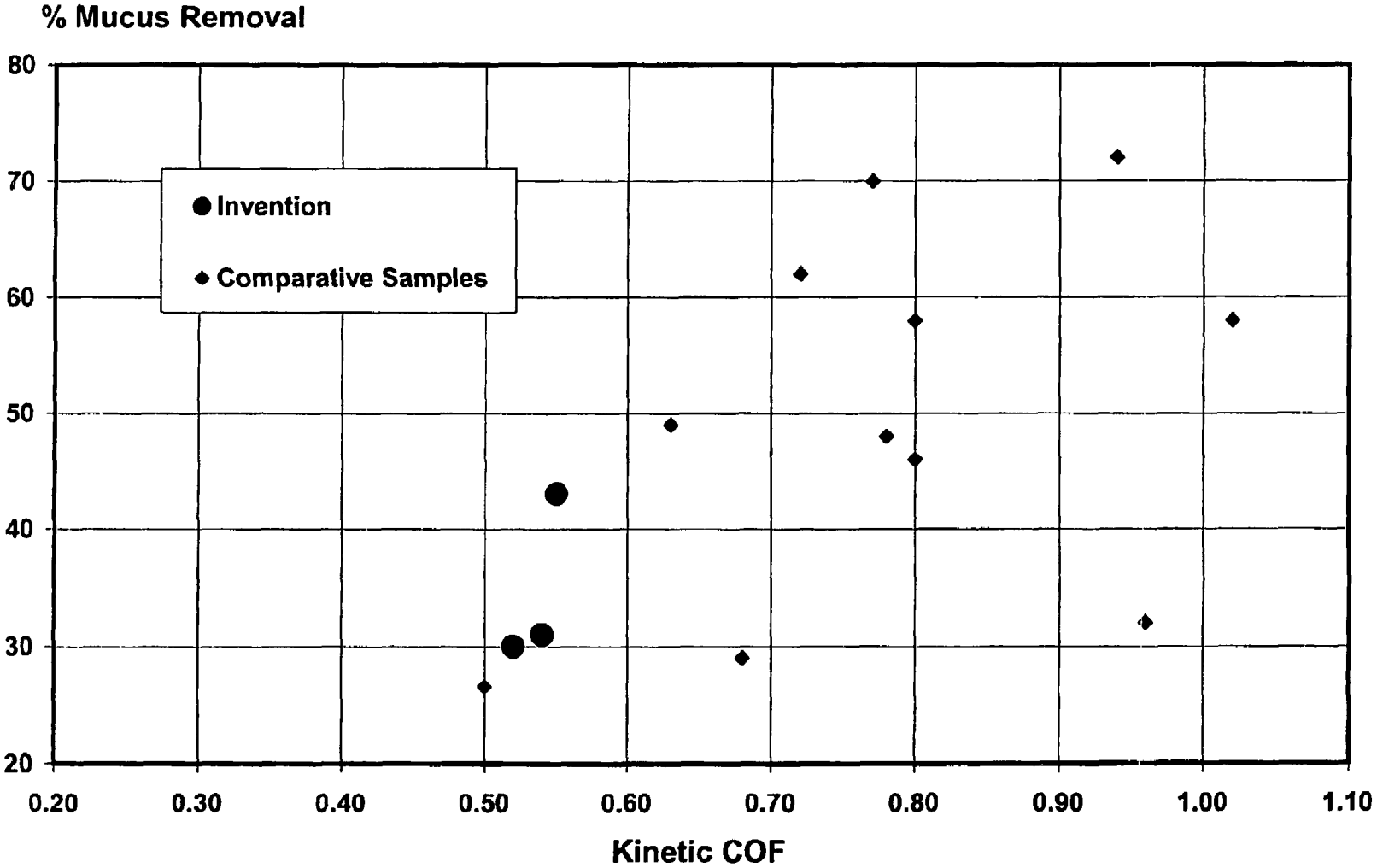
FIG. 5 is a graph of Mucus Removal vs. Coefficient of Friction

The following Examples in conjunction with Tables 1 and 2, and FIGS. 3, 4, and 5 will further explain the invention and the unique properties of the paper produced.

EXAMPLES

Example 1

A pilot tissue machine was used to produce a layered, uncreped throughdried facial tissue web with a basis weight of 21.8 grams per square meter per ply, as described in FIG. 1. A furnish of 1000 lbs of bleached northern softwood kraft fiber was dispersed in a pulper for 30 minutes at a consistency of 4 to 5 percent. The stock was sent to a dump chest and diluted to a consistency of 2 to 3 percent and then transferred to a machine chest. The machine chest stock was then passed through a refiner and refined to approximately 550-600 ml Canadian Standard Freeness. This furnish consisted of approximately 20 percent of the sheet, which was placed in the center-layer of the sheet and not in direct contact with user's hands.

A furnish of 2200 lbs of bleached hardwood kraft fiber was dispersed in a pulper for 20 minutes at a consistency of 10 percent. The stock slurry was sent to a holding chest and mixed with a cationic quaternary imidazoline debonder (Prosoft TQ1003 is commercially available from Hercules Inc. in Wilmington, Del.) for 20 to 30 minutes. The debonder addition rate was 2.8 kg/MT of dry fiber. The debonder mixed slurry was pressed and dewatered to a consistency of approximately 32 percent. The debonder treated stock was carried on a conveyer into a high-density storage chest and subsequently diluted to a consistency of 2 to 3 percent. The diluted stock was then transferred to a second machine chest. This furnish consisted of approximately 60 percent of the tissue web, which was placed in the fabric-layer of the sheet and in direct contact with user's hands.

A furnish of 1000 lbs of broke fiber of similar composition to the above furnish was dispersed in a pulper for 45 minutes at a consistency of 3 to 4 percent. A commercially available bleach solution was added to the pulper and mixed with the broke fiber at the addition rate of 2 gallons per 1000 lbs of dry broke fiber. The stock was sent to a dump chest and diluted to a consistency of approximately 2 percent. The diluted stock was then transferred to a third machine chest. This furnish consisted of approximately 20 percent of the tissue web, which was placed in the air-layer of the tissue web and not in direct contact with user's hands.

A polyamide epichlorohydrin wet strength resin (Kymene 557LX is commercially available from Hercules Inc. in Wilmington, Del.) was added to provide permanent wet strength to the tissue web. The Kymene, diluted to 1.79 percent active solids, was pumped into the stock flow pipe between the machine chest and the fan pump using a chemical addition pump, and supplied at an addition rate of 2 kg/MT of dry fiber.

The machine chest furnishes containing the chemical additives were diluted to approximately 0.1 percent consistency and delivered to the impingement of the outer forming fabric (Appleton Mills, 2164) and inner dewatering fabric (Voith Fabrics 2164-B) using a flow layered headbox of the twin wire C-wrap configuration. The forming fabric speed was approximately 2080 feet per minute. The tissue web was then rush transferred to a transfer fabric (Voith Fabrics, T1607-3) traveling 30 percent slower than the forming fabric using a vacuum shoe to assist the transfer. The transfer shoe vacuum level was about 8.0 inches Hg, and the tissue web consistency was about 25 percent. At a second vacuum roll assisted transfer, the tissue web was transferred and wet-molded onto the throughdrying fabric (Voith Fabrics, T1607-3). The second transfer roll vacuum level was about 10.0 inches Hg, and the tissue web consistency was about 27 percent. The tissue web was dried with two through-air-dryers operating at a temperature of 335° F. to a tissue web consistency of about 98 percent. The tissue web was carried to a reel section on fabric 20 (Asten 960) and transferred to fabric 21 (Asten 960) and then wound into a softroll by a reel.

Two softroll tissue webs were subsequently plied together and passed through a steel-steel calender nip at 300 pounds per linear inch across the width of the nip. The converting line speed was set at 1600 feet per minute. The plied tissue webs were then crimped together using a diamond pattern crimping wheel which was nipped against a flat anvil roll at a load pressure sufficient to bond the two plies to each other.

The crimped two-ply tissue web was passed through a rotogravure printer unit, and was printed with polysiloxane (Y14344 is commercially available from Crompton Corp.). The Y14344 silicone emulsion was diluted with water to yield a half strength emulsion to achieve approximately 0.5 percent silicone solid add-on target. The rotogravure printer had four rolls, in which two were electronically engraved gravure rolls engraved to 1.0 and 1.25 cubic billion microns per square inch, respectively. Each of these two gravure rolls was in contact with the separate doctor chambers through which passed the silicone emulsion chemistry. A doctor blade scraped away the excess silicone so that only the silicone contained within the engraved cells on the gravure rolls is carried. Each of the two gravure rolls came in contact with a rubber transfer roll. The nip between each gravure roll and transfer roll pairs was maintained at approximately ⅜ inch across the web path. The two transfer rolls were set-up to a 0.003 inch gap between the two rubber transfer rolls. The two-ply crimped tissue web passed from the crimper through the two rubber transfer rolls of the rotogravure printer.

The printed two-ply tissue web was then slit to an 8.5 inch wide sheet and wound by a winder into a hardroll. The hardroll of calendered, crimped, printed, and slit material was taken to another machine where it passed over a folding board, which imparted a "C" fold into the sheet and rewound the C-folded web onto a large diameter reel. The wound C-folded sheet was then removed from the reel and cut into 8.5 inch lengths to form a stack of facial tissues 8 inches wide.

Example 2

Example 2 was produced using the same machine settings as described in the Example 1, except with the following changes:

The tissue web consisted of approximately 32 percent of bleached northern softwood kraft fiber, approximately 48 percent of debonder treated bleached hardwood kraft fiber, and approximately 20 percent broke. The broke fiber, of a similar composition to the above furnish, was dispersed in a pulper for 30 minutes at a consistency of 3 to 4 percent. Following the addition of the wet strength resin Kymene, a glyoxylated polyacrylamide dry strength addition (PAREZ 631 NC, commercially available from Cytec Industries, New Jersey) was added to achieve the required tissue web strength. The PAREZ was diluted to approximately 0.86 percent active solids, and was pumped into the stock outlet from the stuffbox by a chemical addition pump at an addition level of 2 kg/MT of dry fiber. The PAREZ addition point was located such that the addition occurred only a few seconds after the Kymene addition point. The tissue web was made at a forming speed of approximately 3,120 feet per minute, at a transfer shoe vacuum level of 14.3 inches Hg, and at a second transfer roll's vacuum level of 9.8 inches Hg.

Two softroll tissue webs were plied together and passed through the steel-steel calender nip at 250 pounds per linear inch load pressure, followed by a rubber-steel nip at 100 pounds per linear load pressure across the width of the nip. The durometer of the rubber roll was 50 Shore A. The crimped two-ply tissue web was printed with polysiloxane (DC2-1149 commercially available from Dow Corning Co.) at approximately 1 percent silicone add-on.

Example 3

Example 3 was produced using the same machine settings as described in Example 2, except with the following changes:

The tissue web consisted of approximately 36 percent of bleached northern softwood kraft fiber and approximately 64 percent of debonder treated bleached hardwood kraft fiber. In which, approximately 44 percent of the hardwood was placed in the fabric-layer of the tissue web and in direct contact with user's hands. The rest of the approximately 20 percent of the hardwood was placed in the air-layer of the tissue web and not in contact with user's hands. The debonder addition rate was 4.2 kg/MT of dry fiber. The wet strength resin Kymene was diluted to 6.25 percent active solid and supplied at an addition level of 4 kg/MT of dry fiber. The dry strength additive PAREZ was diluted to 3 percent active solid and at an addition level of 1 kg/MT of dry fiber. The tissue was made at a forming speed of approximately 2,880 feet per minute, at a transfer shoe vacuum level of 7.1 inches Hg, and at a second transfer roll's vacuum level of 9.8 inches Hg. The tissue was converted at a line speed of approximately 800 feet per minute and the durometer of the rubber roll was 45 Shore A. The printed polysiloxane was Y14344 at an approximately 1 percent silicone solid add-on.

TABLE 1

Test Results

| Sample Description | Mucus Removal (Percent) | COF | Specific Surface Area Ratio, (%) |
|---|---|---|---|
| Invention Example 1 | 43 | 0.55 | 3.0 |
| Invention Example 2 | 30 | 0.52 | 5.8 |
| Invention Example 3 | 31 | 0.54 | 4.6 |
| Experimental Comparative Sample 4 | 27 | 0.50 | 1.5 |
| KLEENEX COTTONELLE Aloe &E bath tissue, double roll - date code 6 J 275 02 | 49 | 0.63 | 6.4 |
| Experimental Comparative Sample 6 | | 0.96 | 2.3 |
| KLEENEX facial tissue - 100 count flat carton, date code 1F106B75 | 32 | 0.96 | |
| Comparative Sample 11 - SCOTTEX bath tissue from Romagnano, Italy | 62 | 0.72 | 10.4 |
| KLEENEX HAPPIES baby wipes from Europe - date code 04 41 164 3 13 09 | 72 | 0.94 | 3.7 |
| Comparative Sample 13 - SCOTTEX bath tissue from Allano, Italy | 58 | 1.02 | 8.6 |
| CHARMIN bath tissue - date code 2003U0101704 | 48 | 0.78 | 12.9 |
| CHARMIN Ultra bath tissue - date code 2276U02040118 | 70 | 0.77 | 7.9 |
| Quilted NORTHERN Ultra bath tissue - date code GE040203N | 58 | 0.80 | 7.2 |
| CHARMIN Comfort bath tissue - UK date code 02 308 1152 UT1 B | | 0.94 | 10.7 |
| CHARMIN Comfort bath tissue - Germany, date code 22423160L1010601 | | 0.86 | 18.4 |
| CHARMIN Deluxe bath tissue - Germany, date code 22103160L1021740 | | 0.89 | 10.6 |
| KLEENEX COTTONELLE bath tissue, date code 2 J 270 02 | 46 | 0.80 | 7.3 |
| KLEENEX UltraSoft facial tissue, date code 1F010A36 | 29 | 0.68 | |
| PUFFS Extra Strength facial tissue - date code 3040B 1 S | | 0.79 | 4.3 |

TABLE 2

Test Results

| Sample Description | Specific Surface Volume Ratio, ($mm^3/mm^2$) | HST, (sec) | Polydialkyl-siloxane Content (%) |
|---|---|---|---|
| Invention Example 1 | 0.11 | 6.4 | 0.4 |
| Invention Example 2 | 0.15 | 28.6 | 1.0 |
| Invention Example 3 | 0.15 | 42.5 | 1.0 |
| Experimental Comparative Sample 4 | 0.06 | 10.9 | 0.5 |
| KLEENEX COTTONELLE Aloe &E bath tissue, double roll - date code 6 J 275 02 | 0.22 | 1.0 | |
| Experimental Comparative Sample 6 | 0.09 | 101.4 | |
| KLEENEX facial tissue - 100 count flat carton, date code 1F106B75 | | 10.1 | |
| Comparative Sample 11 - SCOTTEX bath tissue from Romagnano, Italy | 0.20 | 0.8 | |
| KLEENEX HAPPIES baby wipes from Europe - date code 04 41 164 3 13 09 | 0.13 | 0.6 | |
| Comparative Sample 13 - | 0.20 | | |

TABLE 2-continued

Test Results

| Sample Description | Specific Surface Volume Ratio, ($mm^3/mm^2$) | HST, (sec) | Polydialkyl-siloxane Content (%) |
|---|---|---|---|
| SCOTTEX bath tissue from Allano, Italy | | | |
| CHARMIN bath tissue - date code 2003U0101704 | 0.24 | 0.8 | |
| CHARMIN Ultra bath tissue - date code 2276U02040118 | 0.19 | 0.8 | |
| Quilted NORTHERN Ultra bath tissue - date code GE040203N | 0.13 | 0.7 | |
| CHARMIN Comfort bath tissue - UK date code 02 308 1152 UT1 B | 0.14 | 0.7 | |
| CHARMIN Comfort bath tissue - Germany, date code 22423160L1010601 | 0.34 | 1.1 | |
| CHARMIN Deluxe bath tissue - Germany, date code 22103160L1021740 | 0.15 | 1.1 | |
| KLEENEX COTTONELLE bath tissue, date code 2 J 270 02 | 0.28 | 1.1 | |
| KLEENEX UltraSoft facial tissue, date code 1F010A36 | | 21.8 | |
| PUFFS Extra Strength facial tissue - date code 3040B 1 S | 0.08 | 8.4 | 0.5 |

As seen in Tables 1 and 2, and FIGS. 3, 4, and 5, the inventive tissues possess unique properties that were previously unattainable. For example, the inventive tissues have a COF less than 0.6 and a Specific Surface Area ratio of about 2.5% or greater. In another embodiment, the inventive tissues have a COF less than 0.6 and a Specific Surface Volume ratio of about 0.08 $mm^3/mm^2$ or greater. In anther embodiment, the inventive tissues have a Mucus Removal of about 30% or greater and a COF less than 0.6. In another embodiment, the inventive tissues have a Mucus Removal of about 35% or greater and an HST of about 5 sec. or greater.

Without wishing to be bound by theory, it is desirable for a facial tissue to be able to effectively trap and hold nasal discharge with varying viscous and elastic properties. Low viscosity discharge is easily absorbed into the inter-fiber space of a conventional tissue. High viscosity discharges, however, often cannot absorb into the small pores between the fibers in the time of a typical wiping event (approximately 2 sec). These high viscosity fluids tend to be smeared about without being picked up or trapped by the tissue during use. Therefore, a tissue having an increased Specific Surface Area ratio and an increased Specific Surface Volume ratio provides a structure that holds and traps mucus. This results in a tissue having better wiping results as tested by the Mucus Removal test.

However, tissue sheets having a high Specific Surface Area ratio and a high Specific Surface Volume ratio can be more abrasive and have a higher COF than less topographical sheets. For example, visualize 60 grit sandpaper as compared to 600 grit sandpaper. Such abrasiveness can be irritating to noses. Thus, tissue having a low COF can make the tissue softer and less irritating in use.

Polysiloxane, or other topical lotions, can be applied to the surface of the tissue paper improving softness and reducing the COF. However, polysiloxane application to a tissue paper having a low Specific Surface Volume ratio and a low Specific Surface Area ratio significantly reduces the ability of the tissue to hold and trap mucus resulting in a reduced cleaning ability. Additionally, other attempts to impart improved barrier properties to the tissue paper, such as the use of sizing, also reduce the mucus removal ability of the tissue sheet.

Without wishing to be bound by theory, it is believed the polysiloxane acts as a lubricant preventing the mucus from penetrating or attaching to the smooth surface structure. Surprisingly, the inventors have found that the polysiloxane treated tissue structure of the present invention still retains good cleaning abilities. The inventive tissue structure having a higher Specific Surface Volume ratio and Specific Surface Area ratio can trap the mucus even in the presence of the polysiloxane lubricant, which was unexpected.

It will be appreciated that the foregoing examples, given for purposes of illustration, are not to be construed as limiting the scope of this invention, which is defined by the following claims and all equivalents thereto. For instance, the paper making process used to make the paper can be changed to any suitable paper making process and include creping. The drying can be changed to include other methods such as a Yankee dryer. Additional processing steps can be performed on the paper such as embossing. Further changes are readily apparent to those having skill in the art.

We claim:

1. A facial tissue product having a Specific Surface Volume ratio of about 0.08 $mm^3/mm^2$ or greater, a Hercules Size Test of about 7 seconds or greater, and a Mucus Removal from about 30 to about 70 percent.

2. The facial tissue product of claim 1 comprising an HST of about 15 sec. or greater.

3. The facial tissue product of claim 1 comprising an HST of about 25 sec. or greater.

4. The facial tissue product of claim 1 comprising an HST of from about 7 sec. to about 50 sec.

5. The facial tissue product of claim 1 wherein the Specific Surface Volume ratio is about 0.1 $mm^3/mm^2$ or greater.

6. The facial tissue product of claim 1 wherein the Specific Surface Volume ratio is about 0.14 $mm^3/mm^2$ or greater.

7. The facial tissue product of claim 1 wherein the Specific Surface Volume ratio is from about 0.08 $mm^3/mm^2$ to about 0.35 $mm^3/mm^2$.

8. The facial tissue product of claim 1 wherein the Specific Surface Volume ratio is from about 0.1 $mm^3/mm^2$ to about 0.25 $mm^3/mm^2$.

9. The facial tissue product of claim 1 wherein the Mucus Removal is from about 30 to about 50 percent.

10. A facial tissue product having a Specific Surface Volume ratio from about 0.08 to about 0.35 $mm^3/mm^2$, a Polydialkylsiloxane Content from about 0.4 to about 5 percent, a Hercules Size Test from about 7 to about 50 seconds, a Coefficient of Friction from about 0.50 to about 0.60 and a Mucus Removal from about 30 to about 70 percent.

11. The facial tissue product of claim 10 having a Polydialkylsiloxane Content from about 0.4 to about 1.0 percent.

12. The facial tissue product of claim 10 having a Specific Surface Volume ratio from about 0.11 $mm^3/mm^2$ to about 0.15 $mm^3/mm^2$.

13. The facial tissue product of claim 10 having a Coefficient of Friction from about 0.52 to about 0.55.

14. The facial tissue product of claim 10 having a Hercules Size Test from about 28.6 to about 42.5 seconds.

15. The facial tissue product of claim 10 having a Mucus Removal from about 31 to about 43 percent.

* * * * *